United States Patent [19]

Ditzig

[11] Patent Number: 4,854,881

[45] Date of Patent: Aug. 8, 1989

[54] ROTARY ELECTRICAL CONNECTOR ASSEMBLY

[75] Inventor: Albert Ditzig, Hoffman Estates

[73] Assignee: Telephone Products, Inc., Wheeling, Ill.

[21] Appl. No.: 150,233

[22] Filed: Jan. 29, 1988

Related U.S. Application Data

[63] Continuation-in-part of Ser. No. 22,379, Mar. 5, 1987, Pat. No. 4,764,121, which is a continuation-in-part of Ser. No. 809,217, Dec. 16, 1985, Pat. No. 4,673,228.

[51] Int. Cl.[4] ..... H01R 39/02; H01R 39/38

[52] U.S. Cl. ..... 439/26; 439/21

[58] Field of Search ..... 439/11, 13, 18, 20, 439/21, 23–26, 28, 29, 676

[56] References Cited

U.S. PATENT DOCUMENTS

| | | | |
|---|---|---|---|
| 2,200,794 | 5/1940 | Krantz | 439/23 X |
| 2,265,846 | 12/1941 | Krantz | 439/26 |
| 2,288,259 | 6/1942 | Gladulich | 439/26 |
| 3,185,951 | 5/1965 | Le Beau | 439/26 |
| 3,297,973 | 1/1967 | Wendell | 439/26 |
| 3,321,728 | 5/1967 | Cocco et al. | 439/26 |
| 3,375,479 | 3/1968 | Lowe | 439/26 |
| 4,533,796 | 8/1965 | Engelmore | 439/13 X |
| 4,583,797 | 4/1986 | Engelmore et al. | 339/6 R |

FOREIGN PATENT DOCUMENTS

| | | | |
|---|---|---|---|
| 172206 | 8/1952 | Austria | 439/21 |

*Primary Examiner*—Eugene F. Desmond

*Attorney, Agent, or Firm*—Marshall, O'Toole, Gerstein, Murray, Bicknell

[57] ABSTRACT

An embodiment of a rotary connector assembly, permanently connected to a telephone cord, is attachable to a telephone handset. The assembly prevents tangling of the cord. The assembly includes a spindle partially enclosed within a cylindrical bearing and in mutually rotatable relation therewith. The spindle mounts external conducting rings engaged by wipers mounted on a guide element in turn mounted on a base member which also mounts the cylindrical bearing. Structure is provided to retain all the elements of the assembly in place to facilitate attachment to the handset as a single, integral unit.

Another embodiment of a rotary connector assembly removably engages a telephone handset within the interior thereof. A latch element, depressible to disengage the assembly from the handset, is normally inaccessible from the exterior of the handset, and structure is provided to enable depression of the latch element.

35 Claims, 8 Drawing Sheets

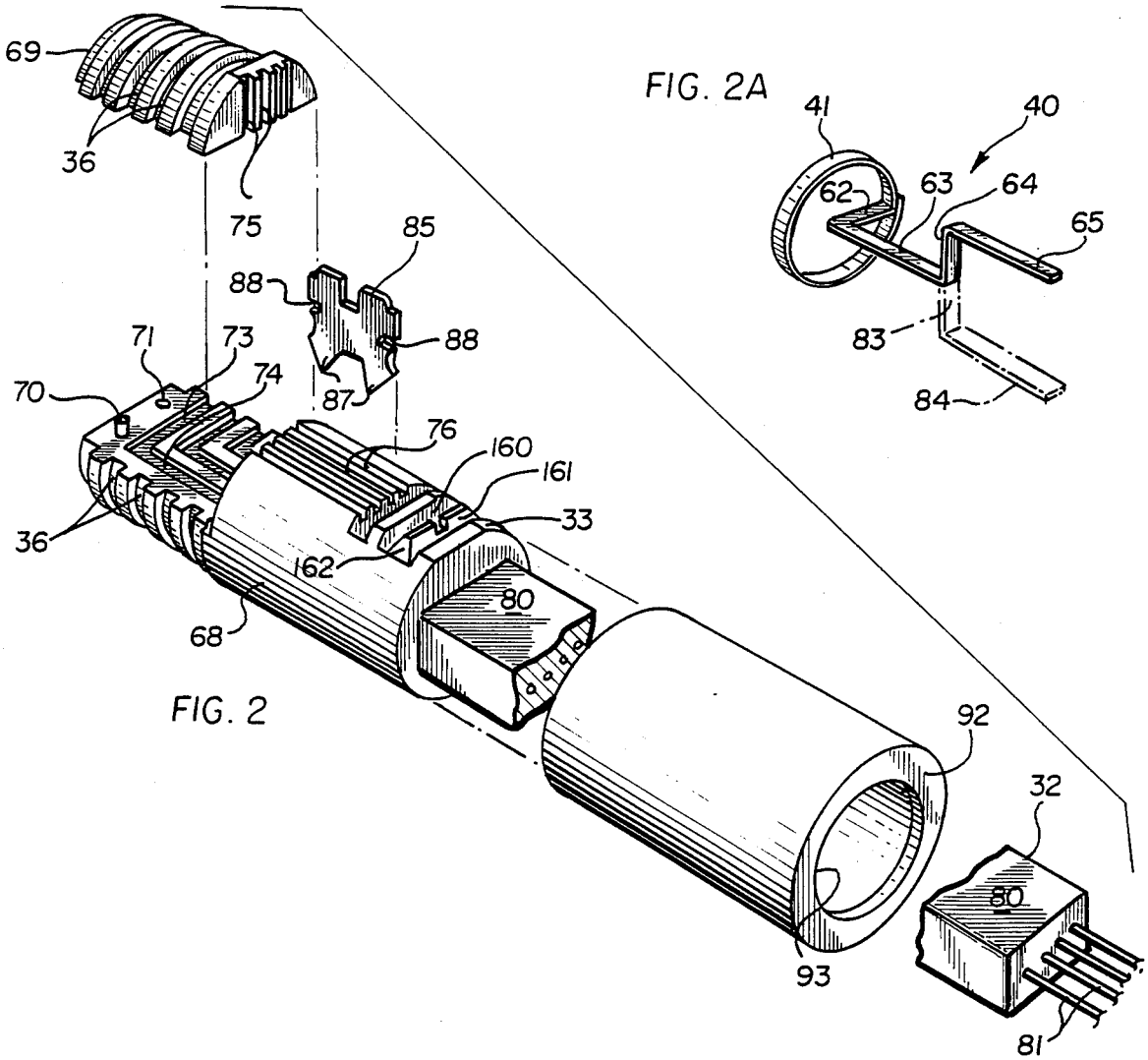
FIG. 2
FIG. 2A
FIG. 3
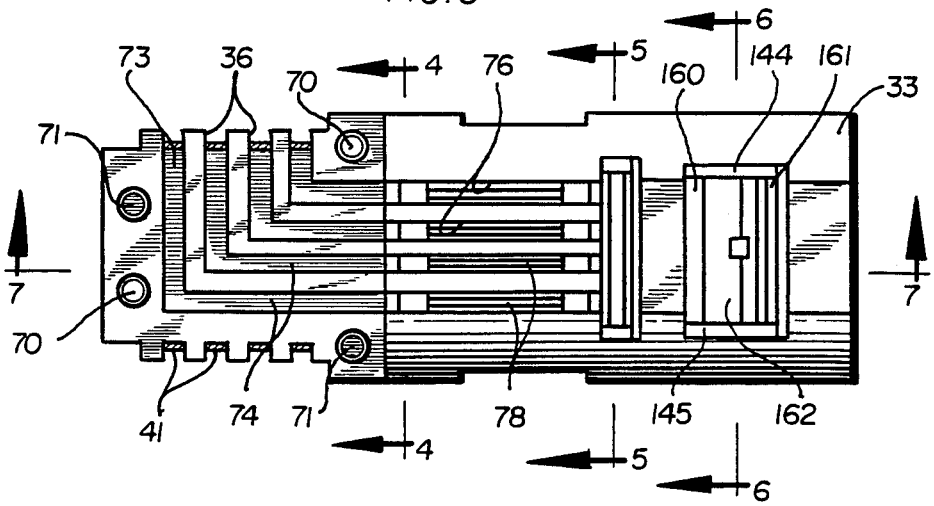

ROTARY ELECTRICAL CONNECTOR ASSEMBLY

This is a continuation-in-part of application Ser. No. 22,379 filed Mar. 5, 1987, entitled "Rotary Electrical Connector", now U.S. Pat. No. 4,764,121 issued Aug. 16, 1988 in turn a continuation-in-part of application Ser. No. 809,217 filed Dec. 16, 1985 and entitled "Rotary Electrical Connector Apparatus", now U.S. Pat. No. 4,673,228 issued June 16, 1987. The disclosures of the antecedent applications are incorporated herein by reference.

BACKGROUND OF THE INVENTION

The present invention relates generally to electrical connectors for connecting a power or communication cable to an appliance or telecommunications equipment and more particularly to a rotary electrical connector assembly for a telephone handset.

A rotary electrical connector is used, for example, in conjunction with a cable that connects the handset to the base of a telephone. The purpose of the rotary electrical connector is to prevent the cable from becoming tangled or twisted when used over an extended period of time, which is undesirable.

The rotary connectors described in the related applications generally comprise a spindle at least part of which is contained within a housing. The spindle and the housing are mutually rotatable, in relation to each other, about a common axis. In some embodiments, male and female modular electrical connecting elements are associated with one or both of the housing and the spindle. The female connecting element associated with the rotary connector receives a modular male connecting element normally located at one end of the telephone cable, and the male modular connecting element associated with the rotary connector normally plugs into a female modular connecting element on the telephone, typically on the handset thereof.

The spindle typically has electrically conductive rings located around its periphery, and these rings are connected by electrical conducting elements extending through the spindle to electrical contact members on one of the modular connecting elements or to other connections with the telephone equipment. The rings are engaged by electrical contact members or wipers typically electrically connected to the other modular connecting element associated with the rotary connector or to the cord or cable conventionally extending between the handset and the base. There is thus formed a rotatable electrical connection between the telephone cable and the handset.

SUMMARY OF THE INVENTION

The antecedent related applications disclose, for the most part, rotary connectors which are separate and discrete from the telephone itself, and are used to retrofit the telephone rather than being part of the original telephone equipment. The present invention is directed to rotary connector assemblies which are part of the original telephone equipment, being "hardwired" to the cable for the telephone handset, in one embodiment, and being removably connected internally within the handset and normally inaccessible for removal purposes.

In one embodiment, suitable for hardwiring to the telephone cord, the rotary connector assembly comprises a spindle having axially spaced first and second end portions between which is a peripherally grooved portion containing the electrically conductive rings. There is a guide element comprising structure for receiving the grooved portion of the spindle. The guide element also comprises structure mounting electrical contacts or wipers in a position to engage the rings on the spindle's periphery. The housing part of the rotary connector is in the form of a cylindrical bearing enclosing that part of the spindle between its grooved portion and its first end portion.

The assembly further comprises a base member for supporting the guide element and the cylindrical bearing. A second member is located in superimposed relation to the base member and is attached thereto. The second member comprises structure for engaging the cylindrical bearing and for retaining the later in a supported position on the base member, when the second member is attached to the base member. The entire assembly comprises structure cooperating to enable the assembly to be attached to, or removed from, the handset of a telephone as a single, integral unit.

The spindle also comprises structure for engaging the guide element and for retaining the latter in a supported position on the base member, when the cylindrical bearing encloses the aforementioned spindle part and is retained in its supported position on the base member. The base member also comprises structure for preventing movement of the spindle and the cylindrical bearing in an axial direction and also comprises structure for preventing movement of the guide element in an axial direction, relative to the spindle, as well as in a direction transverse to the axial direction.

Each wiper mounted on the guide element is part of an electrical contact also including prong portions for removably engaging the sockets of a female electrical connector plug located within the telephone handset.

There is another embodiment of the present invention which is not hard wired to the cable and is removable from the handset but is normally inaccessible therein. This embodiment is employed in connection with a handset having an opening adjacent the speaker end of the handset. There is a female modular connecting element located within the handset, adjacent the speaker end, and spaced from and aligned with the aforementioned opening. The opening receives a rotary connector assembly, and typically, the spindle and at least part of the housing are normally located within the handset. A male modular connector element, associated with the spindle, engages the female modular connecting element located within the handset. The housing comprises bearing means which seats at the handset opening to mount the housing for rotation relative to the handset.

The telephone handset includes a speaker contact housing within the handset, behind a removable mouthpiece at the speaker end. This housing has a rear wall on which is located the female modular connecting element.

The male modular connecting element associated with the spindle comprises a latch element depressible for disengaging the male modular connecting element from the female modular connecting element located within the handset, to enable the withdrawal of the rotary connector assembly from within the handset. The aforementioned latch element is normally located within the handset and is inaccessible through the aforementioned opening in the handset when the male modular connecting element engages the female modular connecting element within the handset.

In accordance with the present invention, structure is provided, at the speaker end of the handset, to permit access to the latch element to depress it and enable disengagement of the male from the female modular connecting element within the handset. This structure is in the form of a guide opening in the rear wall of the speaker contact housing. When the removable mouthpiece is removed, a pin may be inserted through the guide opening for engagement with the latch element to depress the latter to permit removal of the rotary connector assembly from within the handset.

Other features and advantages are inherent in the method and apparatus claimed and disclosed or will become apparent to those skilled in the art from the following detailed description in conjunction with the accompanying diagrammatic drawings.

BRIEF DESCRIPTION OF THE DRAWINGS

FIG. 2 is an enlarged exploded perspective of a part of the rotary connector assembly;

FIG. 2A is a perspective of electrical conducting means carried by the spindle;

FIG. 3 is a plan view illustrating a portion of the spindle employed in the rotary connector assembly;

DETAILED DESCRIPTION

Figure 1:
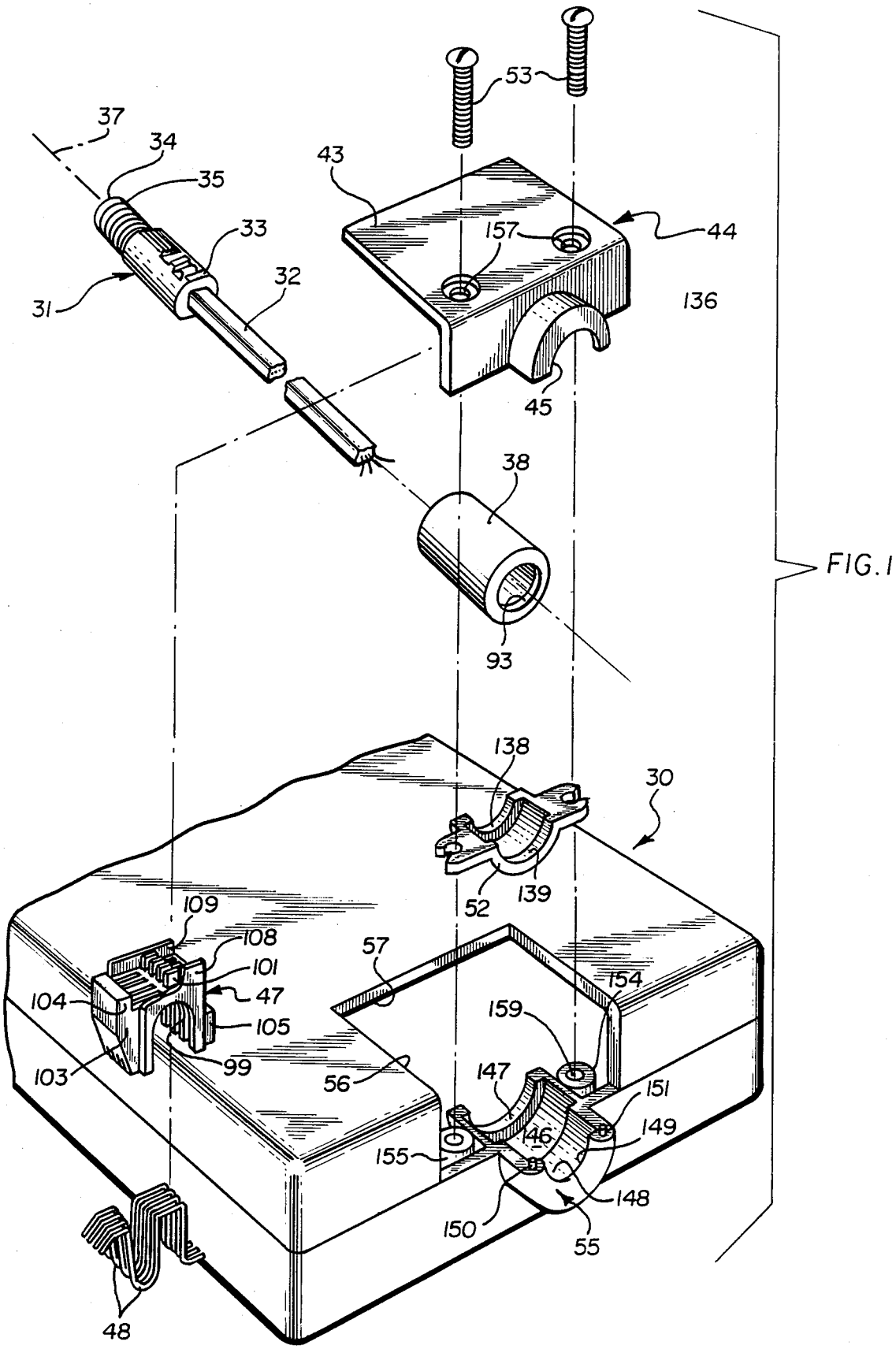
FIG. 1 is an exploded perspective of one embodiment of a rotary connector assembly in accordance with the present invention.
Figure 4:
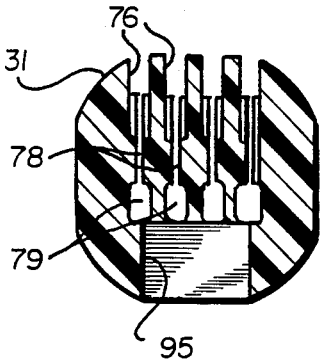
FIG. 4 is a sectional view taken along line 4—4 in FIG. 3.
Figure 5:
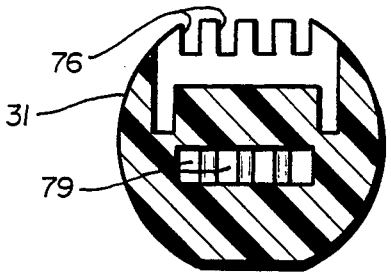
FIG. 5 is a sectional view taken along line 5—5 in FIG. 3.
Figure 6:
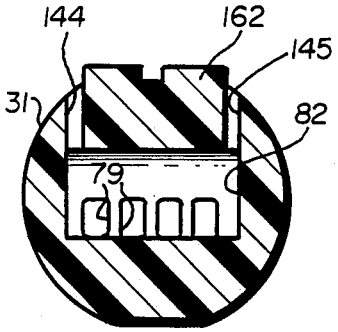
FIG. 6 is a sectional view taken along line 6—6 in FIG. 3.
Figure 9:
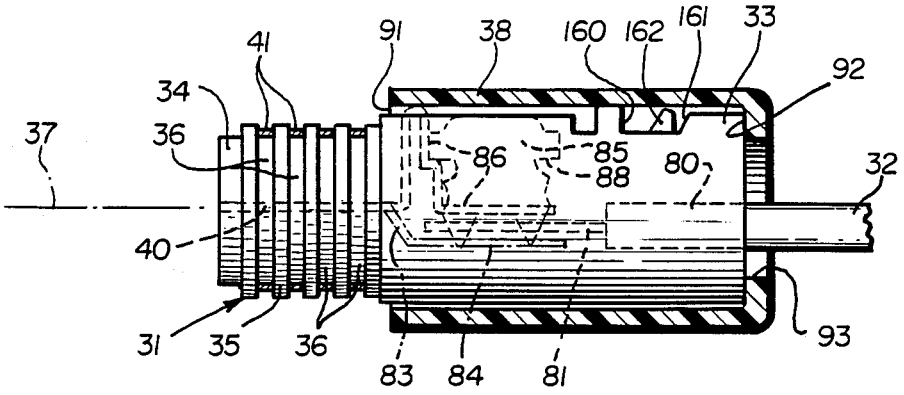
FIG. 9 is a side view, partially in section, illustrating the spindle and cylindrical bearing of the rotary connector assembly.
Figure 10:
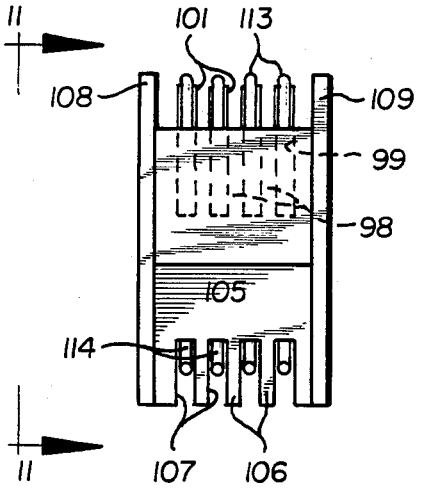
FIG. 10 is an end view of a guide element and associated electrical contacts employed in the rotary connector assembly.

Referring initially to FIGS. 1 and 9, indicated generally at 30 is a portion of a telephone handset with which is associated a rotary connector assembly comprising a spindle 31 connected to a telephone cable or cord 32. Spindle 31 comprises axially spaced first and second end portions 33, 34 respectively and a peripherally grooved portion 35 located between end portions 33, 34 and comprising a plurality of axially spaced peripheral grooves 36, 36 (Fig. 9) each axially spaced from first end portion 33.

The rotary connector assembly also comprises a cylindrical bearing 38 normally enclosing that part of the spindle between first end portion 33 and grooved portion 35 (FIG. 9). Cylindrical bearing 38 and spindle 31 comprise structure cooperating to mount bearing 38 and spindle 31 in mutually rotatable relation about the axis 37 of spindle 31.

Associated with spindle 31 are a plurality of electrical conducting elements 40, 40 (FIG. 2A) each having a ring portion 41 received in a respective one of the spindle's peripheral grooves 36.

Figure 14:
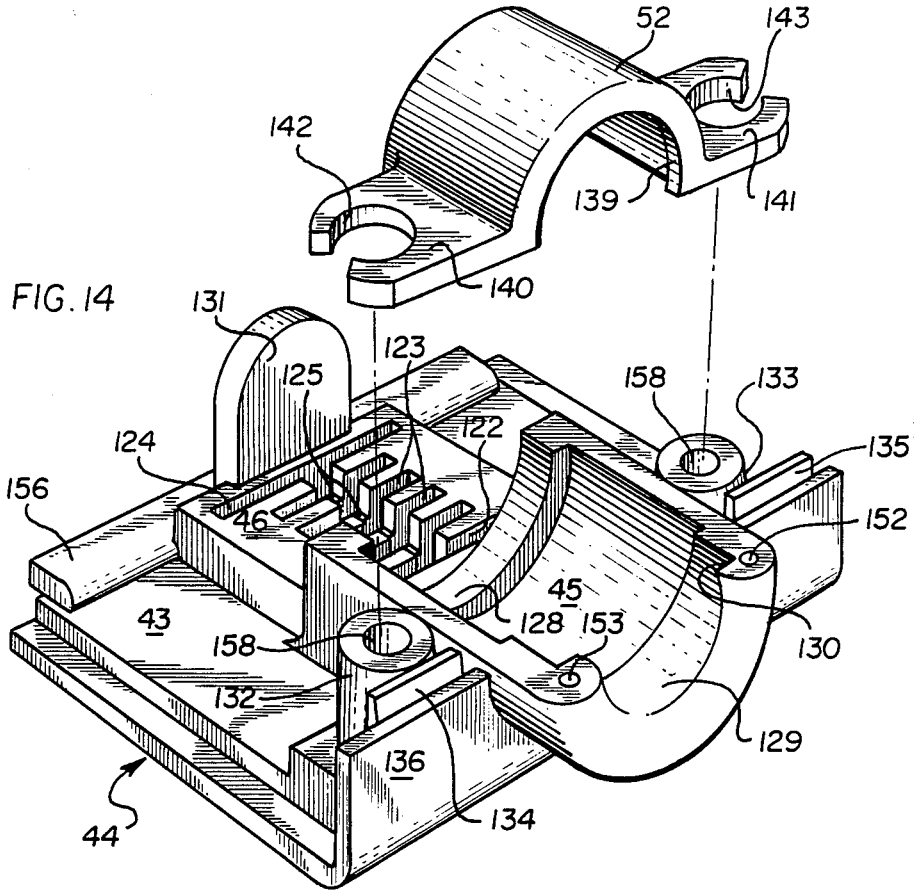
FIGS. 14–17 are perspectives illustrating portions of the rotary connector assembly in increasingly complete stages of assembly.
Figure 15:
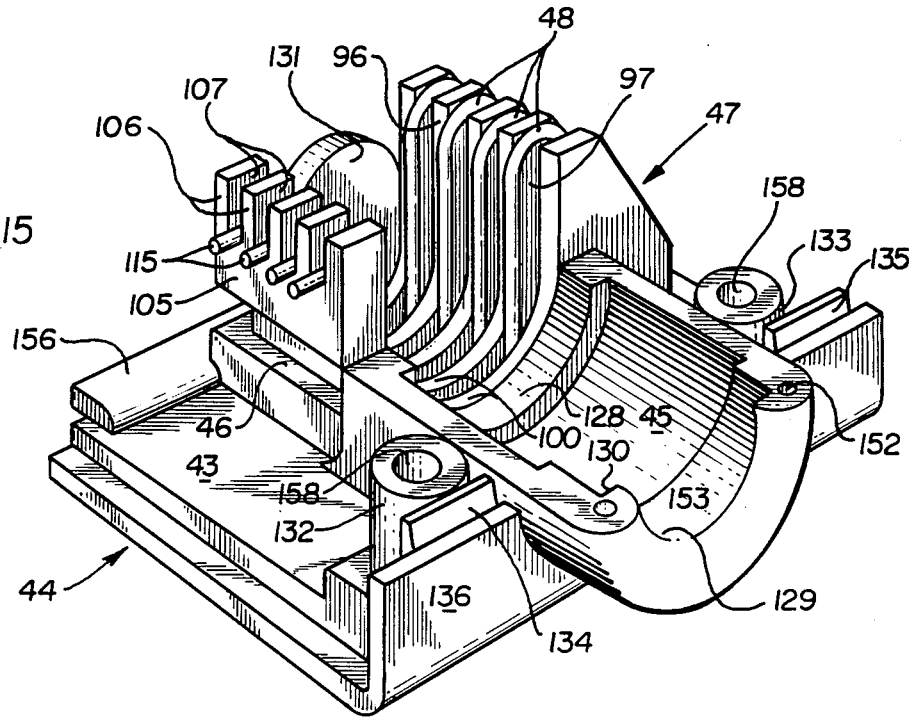
Figure 16:
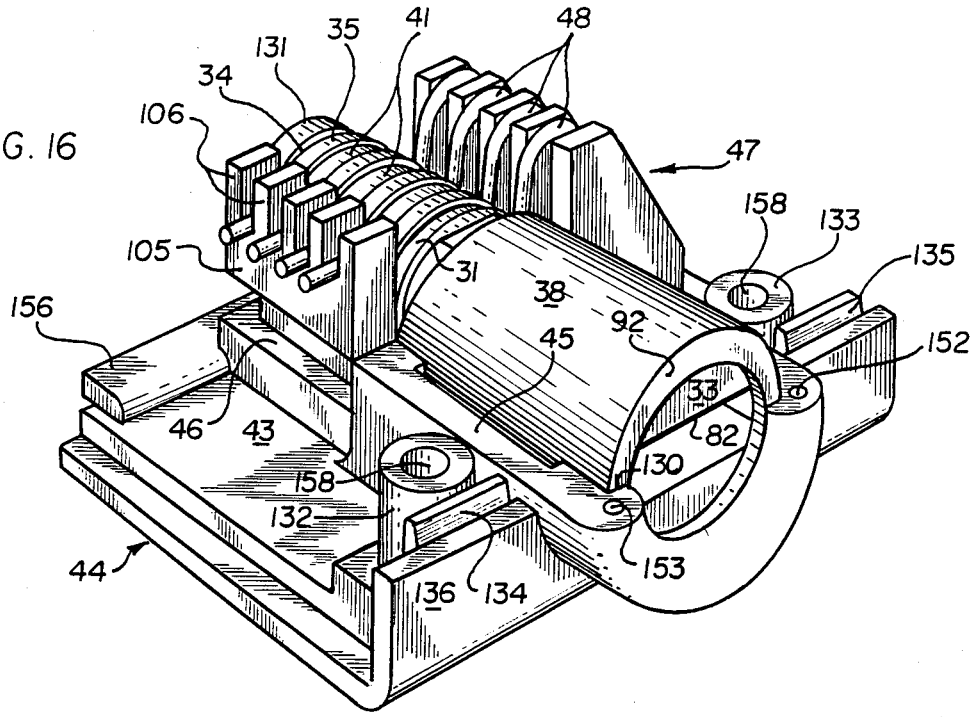
Figure 17:
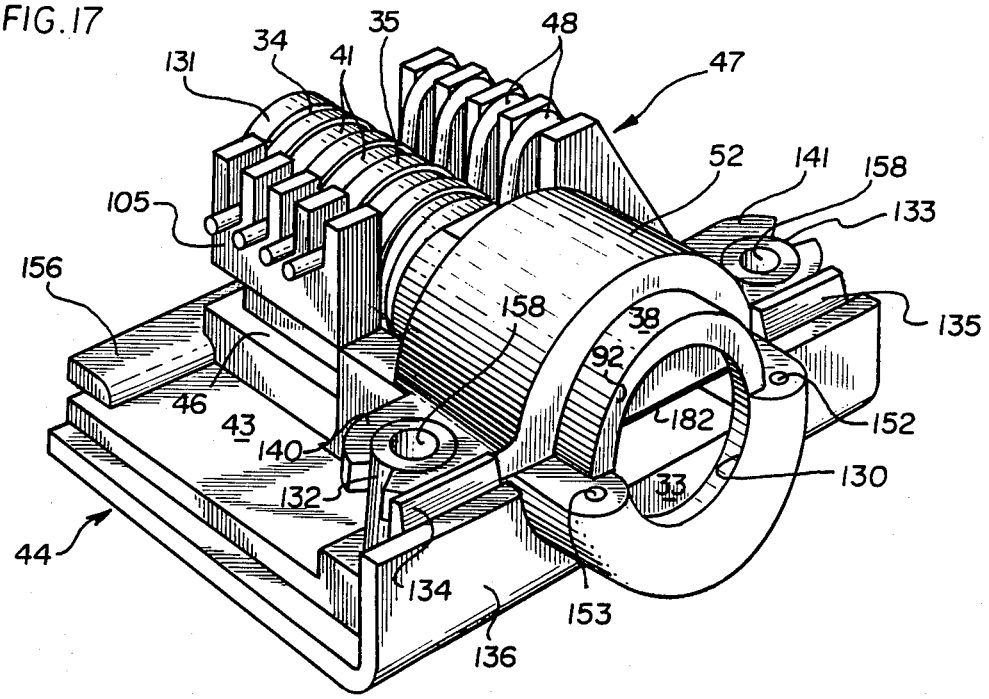
Figure 18:
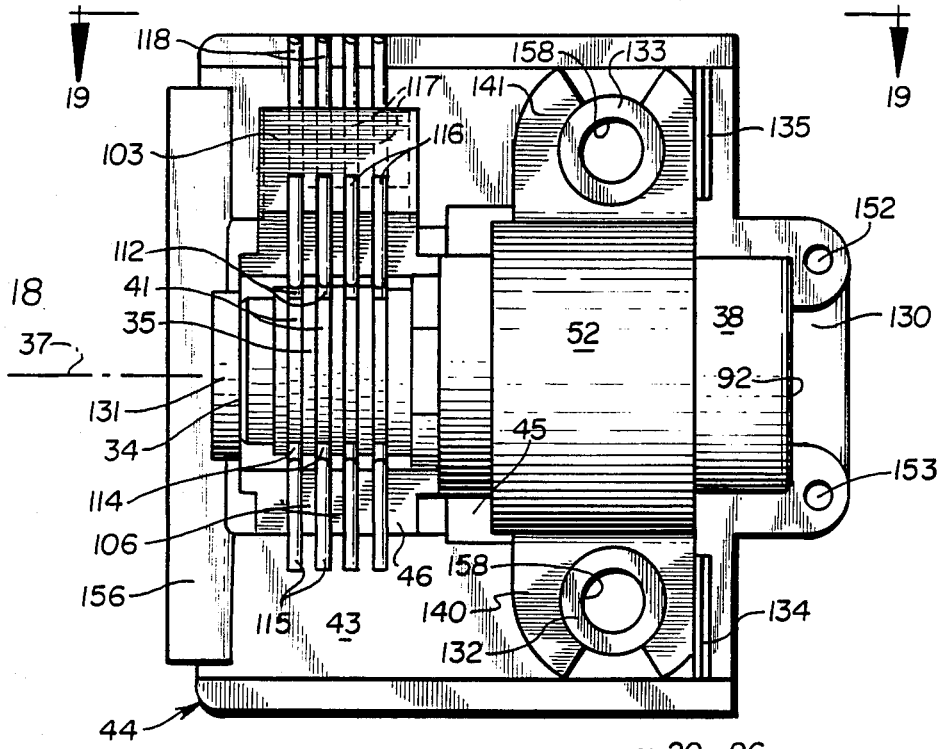
FIG. 18 is a plan view of a completely assembled rotary connector assembly.
Figure 19:
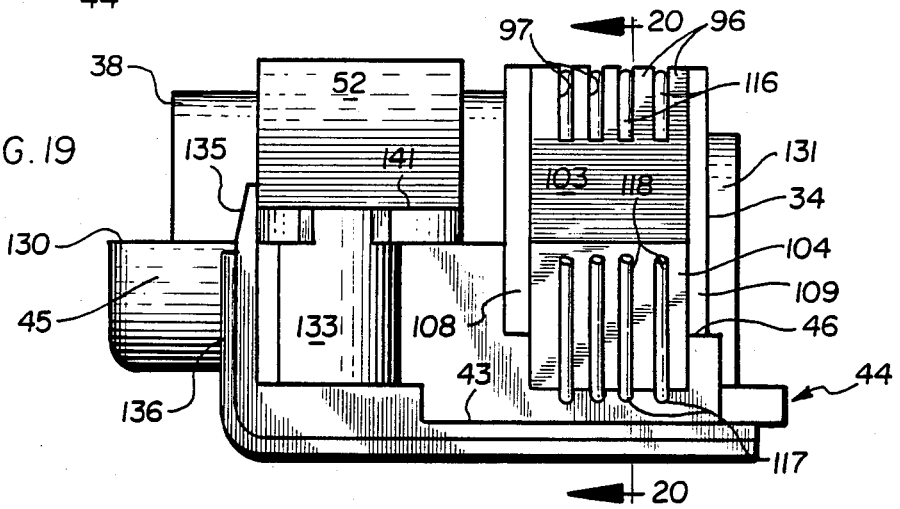
FIG. 19 is a side view of the assembly, as viewed along line 19—19 in FIG. 18.
Figure 20:
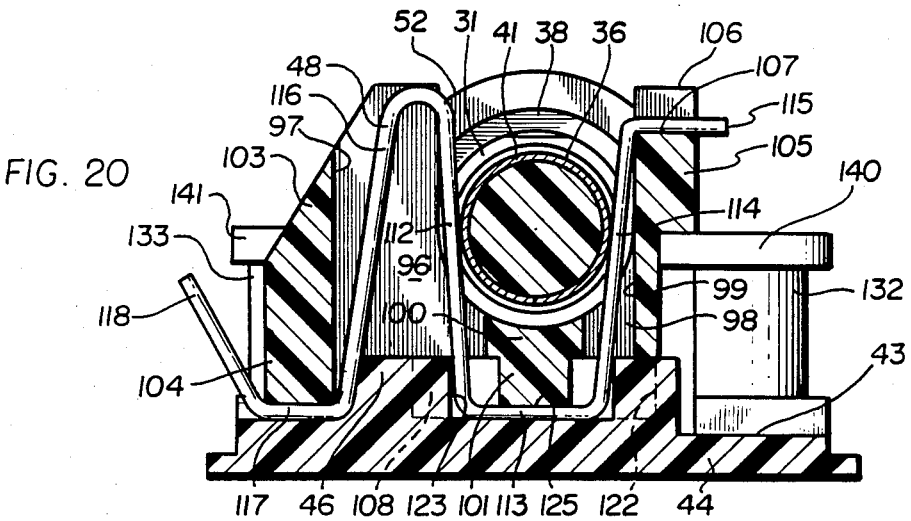
FIG. 20 is a sectional view taken along line 20—20 in FIG. 19.

Referring now to FIGS. 1 and 14–20, the rotary connector assembly further comprises a base member 44 having a planar portion 43 from which project first mounting structure 45, for mounting cylindrical bearing 38, and second mounting structure 46 for mounting a guide element 47. Referring to FIGS. 16–18, guide element 47 comprises structure for receiving grooved portion 35 of spindle 31, and the guide element also comprises structure mounting each of a plurality of electrical contacts 48, 48 (FIG. 1) in a position to engage a respective ring portion 41 of an electrical conducting element 40 when the spindle's grooved portion 35 is received by guide element 47. As shown in FIG. 20, each electrical contact 48 comprises a pair of wiper portions 112, 114 each of which tangentially engages a respective ring portion 41 at a plurality of peripherally spaced (e.g. diametrically opposite) locations on ring portion 41.

The spindle's grooved portion 35 is in a position to be received by guide element 47 when that part of the spindle between its first end portion 33 and its grooved portion 35 is enclosed by cylindrical bearing 38 and the latter is supported by he base member's first mounting structure 45.

When spindle 31, bearing 38 and guide element 47 are positioned on base member 44 in the manner described above, they are held in place there by a second member 52 (FIGS. 1 and 17–19) located in aligned relation to base member 44 and attached to base member 44 with structure to be subsequently described. Second member 52 constitutes structure for engaging cylindrical bearing 38 and for retaining the latter in a supported position on the base member's first mounting structure 45, when second member 52 is attached to base member 44. The spindle's grooved portion 35 constitutes structure for retaining guide element 47 in a supported position on the base member's second mounting structure 46, when (1) cylindrical bearing 38 encloses that part of the spindle between its first end portion 31 and its grooved portion 35 and (2) the bearing is retained in its supported position on the base member's first mounting structure 45 by second member 52.

Thus all the elements of the rotary connector assembly cooperate, in the manner described above, to enable the entire assembly to be attached to, or removed from telephone handset 30 as a single, integral unit. To facilitate this attachment, telephone handset 30 comprises mounting structure at 55 (FIG. 1), the details of which will be subsequently described. An opening 56 in handset 30 receives and accommodates the rotary connector assembly when the latter is attached to handset 30 at 55.

The elements which make up the rotary connector assembly will now be described in greater detail.

Referring initially to FIGS. 2A and 9, there is a conducting element 40 for each groove 36 in the spindle, and each conducting element 40 extends through spindle 31, from the spindle's grooved portion 35 toward the spindle's first end portion 33. As shown in FIG. 2A, the conducting element comprises connecting portion 62 extending between the conducting element's ring portion 41 and a subpart 63 extending in a direction parallel to the axis of spindle 31. Subpart 63 is connected to a transversely extending subpart 64 in turn connected to a subpart 65 also extending in a direction parallel to the axis of the spindle. Subpart 65 is subject to deformation during the connection of the spindle to telephone cord 32, as will be subsequently described.

Referring now to FIGS. 2–9, spindle 31 is composed of two mating parts, a large part 68 and a small part 69. Each part comprises a pair of pins 70, 70 received in a pair of holes 71, 71 on the other part to hold the two parts 68 and 69 in mating engagement. Each spindle part 68, 69 contains approximately one-half of the spindle's grooved portion 35, and approximately one-half of each of the spindle's grooves 36, 36.

Referring to FIGS. 2 and 3, the spindle's large part 68 comprises a series of grooves and channels for receiving various portions and subparts of conducting element 40. More particularly, communicating with each peripheral groove 36 is a laterally extending groove 73 for receiving connecting portion 62 of conducting element 40. Communicating with groove 73 is a groove 74 extending in a direction parallel to the axis of spindle 31. Groove 74 receives subpart 63 of the conducting element.

Small spindle part 69 has grooves (not shown) which correspond to grooves 73 and 74 on large spindle part 69 and which mate therewith when the two spindle parts are engaged together. Small spindle part 68 also comprises a plurality of transverse grooves 75 (FIG. 2) each having an inner end communicating with a groove 74 and an outer end communicating with a respective one of a plurality of channels 76, 76 (FIGS. 2–5) extending in a direction parallel to axis 37 of spindle 31, from the spindle's grooved portion 35 toward the spindle's first end portion 33, on the periphery of the spindle. Each transverse spindle groove 75 receives a subpart 64 of conducting element 40, and each peripheral channel 76 receives a subpart or end portion 65 of the conducting element (FIG. 2A). Extending inwardly from each channel 76 into the interior of spindle 31 is a pocket 78.

Each conducting element 40 is initially placed in grooves 73, 74 of the spindle's large part 68, with the ring portion 41 of the conducting element unformed. After the spindle's small part 69 is mated with the spindle's large part 68, the unformed ring portions 41, 41 initially extend radially outwardly from laterally extending grooves 73, 73. The ring portions are then deformed into the desired circular shape within peripheral grooves 36, 36 on the spindle's grooved portion 35.

Figure 7:
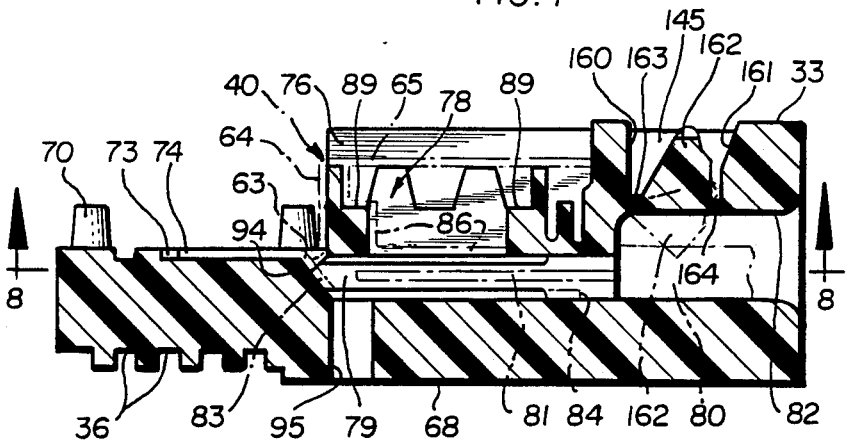
FIG. 7 is a sectional view taken along line 7—7 in FIG. 3.

Referring now to FIGS. 7 and 9, telephone cord 32 comprises an insulated portion 80 terminating at a plurality of uninsulated strands 81, 81. Insulated portion 80 is received within a recess 82 (FIGS. 6–8) extending in an axial direction from the spindle's first end portion 33. Recess 82 communicates with the inner end portions 79, 79 of each pocket 78 (FIGS. 4–7), and each uninsulated strand 81 of cord 32 is received within a respective pocket inner end portion 79 (FIG. 7). Each strand 81 is thus received internally within spindle 31 at a location aligned with the subpart or end portion 65 of a conducting element 40 (FIG. 7). Each strand 81 is electrically connected with a respective subpart 65 by structure now to be described.

A contact jumper 85 (FIGS. 2 and 9), of conventional construction, is inserted through each peripheral spindle channel 76 and urged inwardly into each pocket 78 towards the inner end portion 79 thereof (FIG. 7). In the course of doing so, jumper 85 deforms the conducting element's subpart 65 into the shape illustrated in dash-dot lines at 86 in FIG. 7 and in dotted lines in FIG. 9. Each contact jumper 85 has a pair of pointed portions 87, 87 (Fig. 2) which penetrate both the deformed subpart 86 of conducting element 40 and a strand 81 of cable 32, thereby effecting an electrical connection between conducting element 40 and cable strand 81. Each contact jumper 85 has a pair of shoulders 88, 88 (FIG. 2) which come to rest on a pair of ledges 89, 89 in pocket 78 (FIG. 7) to limit the extent to which the contact jumper penetrates into the interior of spindle 31. Ledges 89, 89 in pocket 78 comprise structure for seating contact jumper 85 in a position to engage both a strand 81 and a deformed first portion 86 of conducting element 40.

Figure 8:
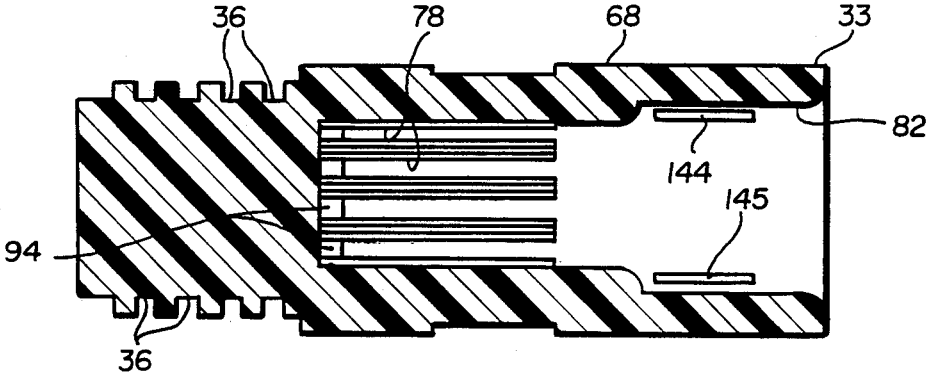
FIG. 8 is a sectional view taken along line 8—8 in FIG. 7.

There is an alternative embodiment for electrically connecting strand 81 to conducting element 40, employing contact jumper 85. This embodiment employs a plurality of internal channels 94, 94 each directly connecting a groove 74, on large spindle part 68, to the inner end portion 79 of a pocket 78 (FIGS. 7–8). Referring to FIGS. 2A, 7 and 9, in this alternative embodiment, each conducting element 40 comprises a subpart 83 extending through internal channel 94 and integral with an end portion 84 located in the pocket's inner end portion 79 and aligned with strand 81 (FIGS. 7 and 9). An opening 95 (FIGS. 4 and 7) in large spindle part 68 facilitates the placement of subparts 83, 84.

Referring to FIGS. 2–3 and 7, located on spindle 31 between peripheral channels 76, 76 and the spindle's first end portion 33 are transverse slots 160, 161 defining therebetween a portion 162 having a wedge-shaped cross section (FIG. 7). Slot 160 terminates inwardly at necked-down portion 163, separating slot 160 from recess 82, and slot 161 terminates inwardly at a thin portion 164 separating slot 161 from recess 82. Transverse slots 160, 161 and wedge-shaped portion 162 are all bounded on opposite sides thereof by a respective one of a pair of slots 144, 145 extending in a direction parallel to the spindle axis and communicating, in an inward direction, with recess 82 (FIGS. 3 and 6–8).

Referring now to FIG. 7, wedge-shaped portion 162 can be urged into engagement with insulated portion 80 of cord 32 to hold the cord in place in recess 82. This can be accomplished by pushing portion 162 inwardly with sufficient force to break thin portion 164, causing wedge-shaped portion 162 to pivot inwardly at 163 and into engagement with the cord's insulated portion 80; as shown in dash-dot lines in FIG. 7.

Referring now to FIGS. 1–2 and 9, cylindrical bearing 38 has an open end 91 (FIG. 9) through which spindle 31 is received into bearing 38. At an end of bearing 38 opposite opening 91 is an end wall 92 against which abuts the spindle's first portion 33. End wall 92 has an opening 93 through which extends telephone cord 32. As shown in FIG. 9, cylindrical bearing 38 encloses parts of spindle 31 except for the spindle's grooved portion 35, and bearing 38 thus also encloses at least part and preferably all of each contact jumper 85.

Guide element 47 is illustrated in FIGS. 1, 10–13 and 15–20. The guide element has a generally U-shaped configuration which receives and partially surrounds spindle grooved portion 35 and comprises a plurality of first side members 96, 96 between which are located slots 97, 97. Spaced from first side members 96, 96 are a plurality of second side members 98, 98 between which are located slots 99, 99. Connecting one end of first side members 96, 96 to one end of second side members 98, 98 is a connecting portion 100 from which project a plurality of spacers 101, 101 extending away from connecting portion 100 in a direction opposite that in which members 96, 98 extend. Spacers 101, 101 are located between a pair of end legs 108, 109 extending in the same direction as the spacers. Each slot 97 between a pair of first side members 96, 96 terminates at an unslotted extension 103 integral with all of side members 96, 96 and having a projection 104 remote from spacers 101, 101. Each slot 99 between a pair of second side members 98, 98 terminates at an unslotted part 105 integral with all of side members 98, 98 and having projections 106, 106 extending in a direction away from first side members 96, 96. Located between projections 106, 106 are slots 107, 107.

As noted above, there are a plurality of electrical contacts 48, 48 each for tangentially engaging a respective ring portion 41 of electrical conducting element 40 at a plurality of peripherally spaced locations on ring portion 41. The electrical contacts are shown in FIGS. 1, 10–13 and 15–20.

Each electrical contact 48 comprises first and second wiper portions 112, 114, respectively, joined together by a connecting portion 113. When an electrical contact 48 is mounted on guide element 47, the contact's connecting portion 113 abuts against a spacer 101, while first wiper portion 112 extends through a slot 97 between two adjacent first side members 96, 96, and second wiper portion 114 extends through a slot 99 between two adjacent second side members 98, 98.

Second wiper portion 114 is integral with an end portion 115 which extends through a slot 107 between projections 106, 106 on guide element 47. First wiper portion 112 is integral with a return portion 116 which extends through a slot 97 located between a pair of first side members 96, 96 on guide element 47. Return portion 116 is integral with an intermediate portion 117 which abuts against the end of projection 104 on guide element 47. Intermediate portion 117 is integral with a prong 118 which is removably receivable within socket in a female electrical connector plug 119 at the end of a cable 120 (Fig. 11) located within the interior of telephone handset 30 and connected to the telephone components therein (not shown).

As previously noted, base member 44 comprises structure, at 46 (FIG. 14), which mounts the subassembly comprising guide element 47 and electrical contacts 48, 48 (FIG. 15). Base member 44 also includes structure, at 45 (FIGS. 14–15), which mounts the subassembly comprising spindle 31 and cylindrical bearing 38 (FIG. 16). Base member 44 is illustrated in FIGS. 1 and 14–20. Mounting structure 46 will be discussed initially.

Mounting structure 46 constitutes a projection on planar portion 43 of base member 44 and comprises a pair of spaced apart, parallel, recessed end slots 122, 124. End slot 122 receives end leg 108 on guide element 47, and end slot 124 receives end leg 109 on guide element 47. Located between end slots 122, 124 and parallel therewith are a plurality of shorter, recessed slots 123, 123 each for receiving a connecting portion 113 of an electrical contact 48. Located between each of the recessed slots 122, 123, 124 are a plurality of ledges 125, 125 each for supporting a spacer 101 of guide element 47. First side members 96, 96 and second side members 98, 98 of guide element 47 abut against the surface of mounting structure 46.

When guide element 47 and electrical contacts 48, 48 are supported on base member 44, they assume the position shown in FIG. 15. Once the subasssembly composed of guide element 47 and electrical contacts 48, 48 are supported in place on base member 44, the other subassembly comprising spindle 31 and cylindrical bearing 38 are assembled in place as shown in FIGS. 16 and 20. As previously noted, ring portions 41, 41 located in grooves 36, 36 of spindle 31 are engaged by wiper portions 112, 114 of electrical contacts 48, 48, and the spindle's grooved portion 35 is received between first and second side members 96, 98 of guide element 47.

Because slots 122, 124 on the base member's second mounting structure 46 engage legs 108, 109 on guide element 47, they prevent movement of the guide element in an axial direction, relative to spindle 31, and they also prevent movement of the guide element along base member 44 in a direction transverse to the axial direction.

Cylindrical bearing 38 is supported by the base member's first mounting structure 45, and that structure will now be described, with particular reference to FIGS. 14–16. Spaced apart at opposite ends of first mounting structure 45 are a pair of concave seat portions 128, 129 on which opposite ends of cylindrical bearing 38 are respectively seated (FIG. 16). Located to the outside of concave seat portion 129 is a lip 130 against which abuts end wall 92 of bearing 38 (FIG. 16). Located on base member 44, at an axially opposite end from lip 130 is a barrier member 131 against which abuts second end portion 34 of spindle 31. Lip 130 and barrier member 131 constitute stops for limiting axial movement of the subassembly composed of spindle 31 and cylindrical bearing 38, when that subassembly is positioned in place on base member 44.

Base member 44 also comprises an end wall 136 adjacent mounting structure 45. Alongside of end wall 136 are a pair of bosses 132, 133 and a pair of end members 134, 135 all of which cooperate with second member 52 to mount the latter on base member 44 (FIGS. 17–20).

Second member 52 comprises a pair of concave seat portions 138, 139 (FIG. 1) for engaging cylindrical bearing 38. Extending in opposite directions from second member 52 are a pair of ear portions 140, 141 (FIG. 14) at the terminal ends of which are located keyhole shaped cutouts 142, 143 each for engaging around the outside of a respective boss 132, 133 on base member 44 (FIG. 17). The arrangement described in the preceding sentence provides an interference fit for ear portions 140, 141 on bosses 132, 133. End members 134, 135 abut against ear portions 140, 141 when the latter engage bosses 132, 133.

When second member 52 is attached to base member 44, in the manner described above, the engagement of the second member's concave seat portions 138, 139 with the outer surface of cylindrical bearing 38 acts to retain bearing 38 in a supported position on the base member's first supporting structure 45. With second member 52 thus assembled in place (FIG. 17), the rotary connector assembly is complete and is ready to be attached, as a single, integral unit, to handset 30, utilizing mounting structure 55 on the handset (FIG. 1).

Figure 11:
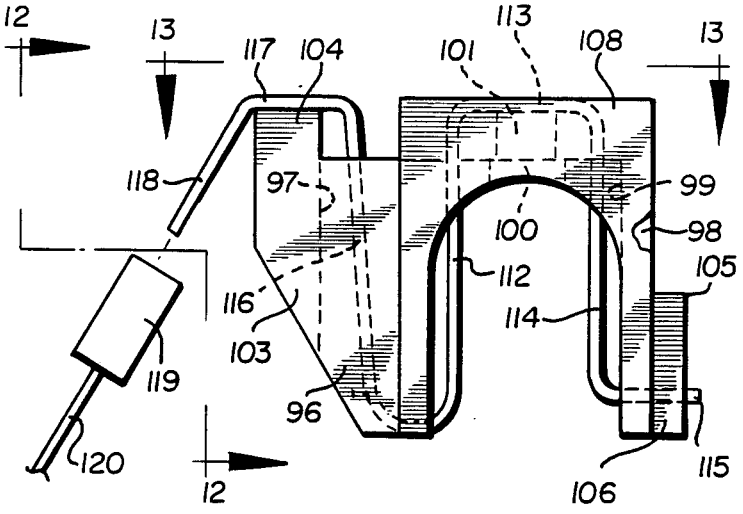
FIG. 11 is a side view of the guide element and contacts, as viewed from the left of FIG. 10.
Figure 12:
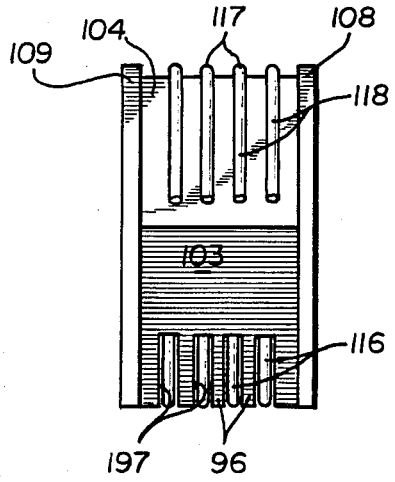
FIG. 12 is an end view of the subject matter of FIG. 11, as viewed from the left of FIG. 11.
Figure 13:
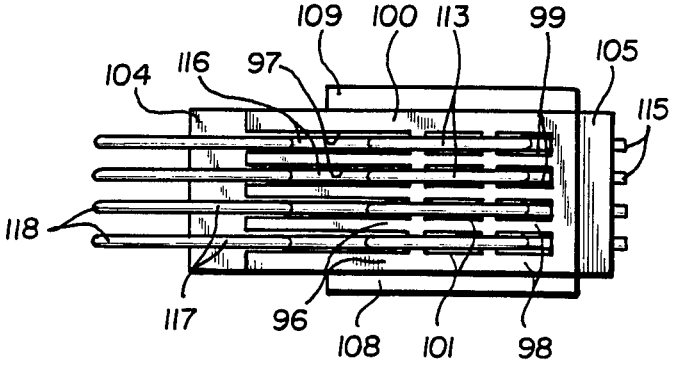
FIG. 13 is a plan view of the subject matter of FIG. 11, as viewed from above.

Before the rotary connector assembly is mounted on hand-set 30, prongs 118, 118 on electrical contacts 48, 48 are connected to female electrical connector plug 119 in the hand-set (FIG. 11). Cable 120 connected to plug 119 is long enough, and has enough play, to enable plug 119 to be withdrawn through hole 56 out of handset 30 for attachment to the prongs.

Mounting structure 55 comprises a concave recessed portion 146 for receiving second member 52, and a pair of spaced apart concave seating portions 147, 148 on which opposite ends of bearing 38 are seated. Mounting structure 155 also includes a semi-circular lip 149 for engaging with end wall 92 of cylindrical bearing 38. Located on lip 149 are a pair of pins 150, 151 for engaging with openings 152, 153 on lip 129 of mounting structure 45 on base member 44 (FIGS. 14–18). A pair of bosses 154, 155 on handset mounting structure 55 align with bosses 132, 133 on base member 44. An elongated lip 156 located at an end of base member 44 opposite that member's end wall 136 (FIGS. 14–18) engages beneath an edge 57 of opening 56 (FIG. 1) when base member 44 is assembled to hand set 30. Threaded fasteners 53, 53 extend through openings 157, 157 in planar portion 43 of base member 44 (FIG. 1), through openings 158, 158 in bosses 132, 133 of base member 44 (FIGS. 14–18) and into threaded openings 159, 159 in bosses 154, 155 of handset mounting structure 55 (FIG. 1), and threaded fasteners 53 engage threaded openings 159, 159.

Figure 21:
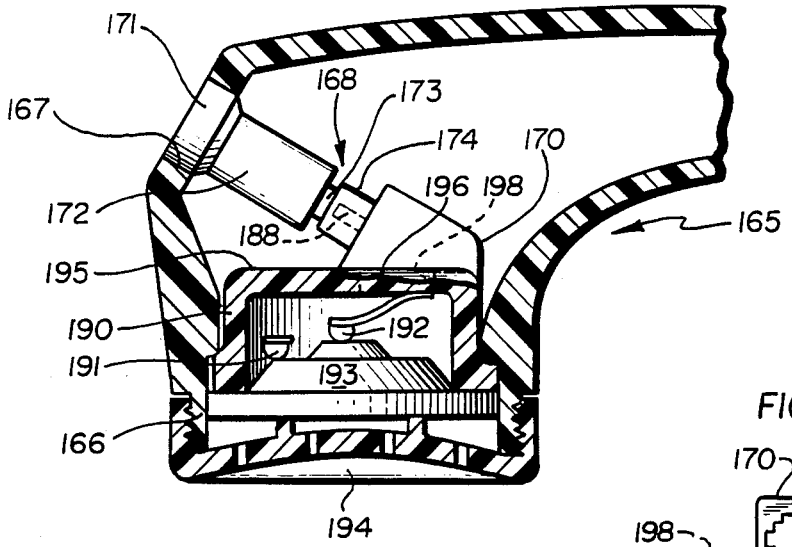
FIG. 21 is a fragmentary sectional view of a telephone handset employing another embodiment of a rotary connector assembly in accordance with the present invention.
Figure 23:
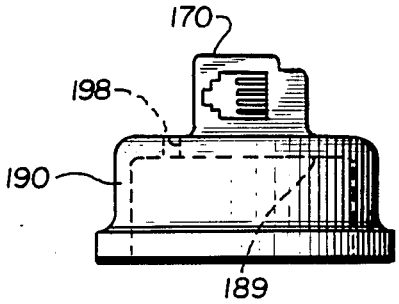
FIG. 23 is a side view showing the telephone handset's speaker contact housing and the female modular connector element associated therewith.
Figure 22:
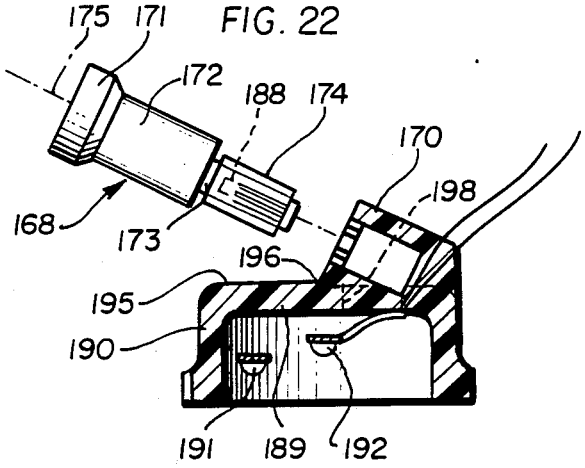
FIG. 22 is a view similar to FIG. 21 showing the rotary connector assembly disengaged from the interior of the telephone handset.
Figure 24:
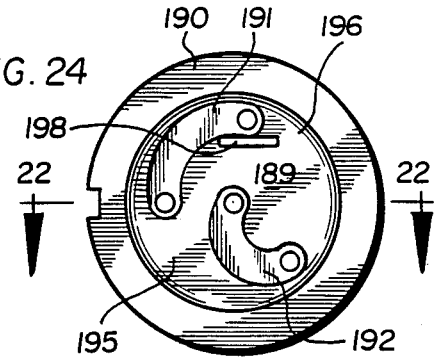
FIG. 24 is a bottom view of the subject matter illustrated in FIG. 23.

Referring now to the embodiment of FIGS. 21–25, and initially to FIG. 21, indicated generally at 165 is a telephone handset having a speaker end 166 and an opening 167 adjacent the speaker end. Located within handset 165 adjacent speaker end 166, and aligned with and spaced from opening 167, is a first female modular connecting element 170. Opening 167 receives a rotary connector assembly indicated generally at 168. At least a part, and preferably virtually all of the rotary connector assembly is located within hand-set 165.

Figure 25:
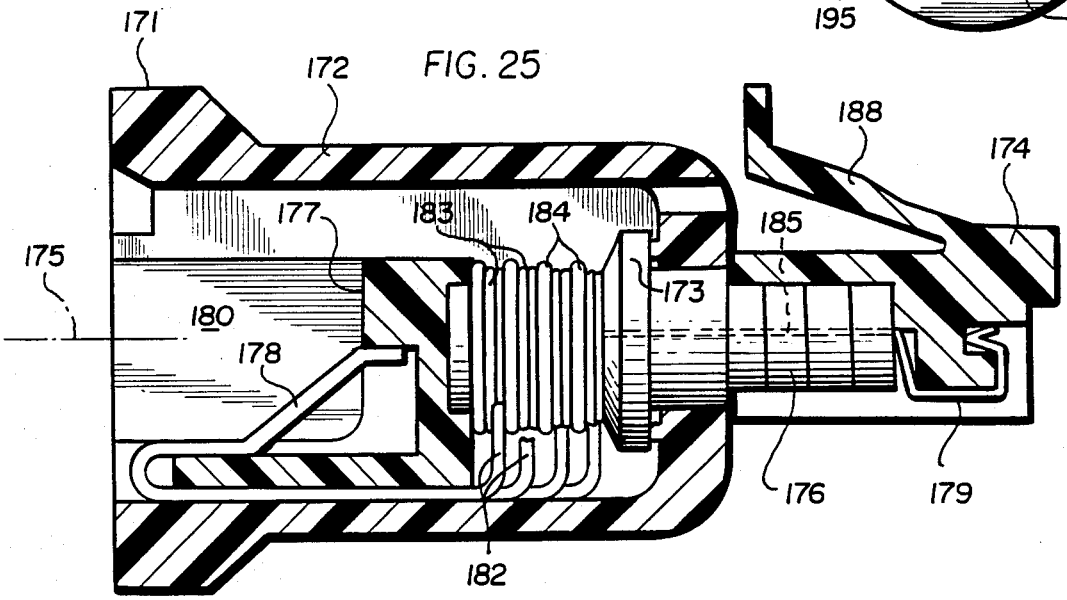
FIG. 25 is an enlarged sectional view of the rotary connector assembly shown in FIGS. 21–22.

Rotary connector assembly 168 comprises a housing 172 and a spindle 173 received within housing 172 (Fig. 25). Housing 172 and spindle 173 comprise structure which mount the housing and the spindle in mutually rotatable rotation about a common axis of rotation 175. Housing 172 comprises a bearing portion 171 for seating at handset opening 167 to mount the housing for rotation relative to the handset.

Mounted on an axial extension 176 of spindle 173 is a male modular connecting element 174, of conventional construction (FIG. 25). Male modular connecting element 174 engages within first female modular connecting element 170 when the rotary connector assembly 168 is inserted through opening 167 into the interior of hand-set 165. Male modular connecting element 174 is fixed on spindle extension 176 so that the male modular connecting element rotates with spindle 173.

Located within housing 172 is a second female modular connecting element 177. Second female modular connecting element 177 is fixed within housing 172 so as to rotate with the housing. When rotary connector assembly 168 is located within hand-set 165, in the manner shown in FIG. 21, second female modular connecting element 177 is aligned with opening 167. Second female modular connecting element 177 has an open portion 180 for receiving a conventional male modular connecting element, such as 174, connected to a telephone cord.

The second female modular connecting element is of conventional construction and includes a plurality of contact members 178, 178 for engagement by cooperating contact members 179, 179 on a conventional male modular connecting element. Each contact member 178 is electrically connected to a wiper 182 which engages electrical conducting rings 183, 183 located in peripheral groves 184, 184 on spindle 173. Wipers 182, 182 electrically connect second female modular connecting element 177 to the electrical conducting rings 183, 183 on the exterior of spindle 173. Each conducting ring 183 on the exterior of spindle 173 is electrically connected, by a connecting portion 185, to a contact member 179 on male modular connecting element 174. Connecting portion 185 extends through the interior of spindle 173.

A more detailed description of the structure described in the preceding four paragraphs, and illustrated in FIG. 25, is contained in the antecedent applications and the disclosures thereof are incorporated herein by reference.

Male modular connecting element 174 comprises a latch 188 depressible for disengaging the male modular connecting element from first female modular connecting element 170, to enable withdrawal of rotary connector assembly 168 from within handset 165. Unless latch 188 is depressed, rotary connector assembly 168 cannot be withdrawn from within handset 165. Latch element 188 is located within handset 165 and is inaccessible through opening 167 when male modular connecting element 174 engages first female modular connecting element 170; and the latch element is normally otherwise inaccessible from a location outside handset 165.

In accordance with the present invention, provision is made to enable one to obtain access to latch 188 so as to enable one to depress the latch, in turn enabling withdrawal of rotary connector assembly 168 from within handset 165.

Located within handset 165, at speaker end 166, is a speaker contact housing 190 (FIGS. 21–24) comprising a pair of contacts 191, 192 bearing against a speaker element 193 which in turn engages against a mouthpiece element 194 threadedly engaged to hand-set 165 at speaker end 166 (Fig. 21).

Speaker contact housing 190 comprises a rear wall 189 having a first portion 195 relatively close to handset opening 167 and a second portion 196 relatively remote from opening 167. First female modular connecting element 170 is located on the rear wall's second portion 196, and female modular connecting element 170 extends from rear wall 189 in a direction away from mouth-piece element 194.

Rear wall 189 has an opening 198 located alongside first female modular connecting element 170. A pin may be inserted through opening 198, from speaker end 166, to engage and depress latch member 188 on male modular connecting element 174. Opening 198 acts as a guide to direct a pin inserted through the opening into engagement with latch 188. In order to insert the pin through opening 198, one manually removes threaded mouthpiece element 194 from its threaded engagement with handset 165 at speaker end 166. Mouthpiece element 194 normally prevents access to opening 198 in rear wall 189 of speaker contact housing 190, but when mouthpiece element 194 has been disengaged from speaker end 166, access to opening 198 is provided.

The foregoing detailed description has been given for clearness of understanding only, and no unnecessary limitations should be understood therefrom, as modifications will be obvious to those skilled in the art.

I claim:

1. A rotary connector assembly for the handset of a telephone, said assembly comprising:

spindle means comprising axially spaced first and second end portions, and a grooved portion comprising a plurality of axially spaced peripheral grooves each axially spaced from said first end portion;

said spindle means having an axis of rotation;

a plurality of electrical conducting elements each having a ring portion received in a respective one of said peripheral grooves of the spindle means;

a plurality of electrical contacts;

a U-shaped element comprising means for receiving said grooved portion of the spindle means;

said element also comprising means mounting each of said electrical contacts in a position to engage a respective ring portion when the grooved portion of the spindle means is received by the element;

each electrical contact comprising means for tangentially engaging a respective ring portion at a plurality of peripherally spaced locations on the ring portion;

bearing means for the spindle means;

said bearing means and said spindle means comprising means cooperating to mount said bearing means and said spindle means in mutually rotatable relation;

first mounting means, separate and discrete from said bearing means, for supporting said bearing means;

and second mounting means, separate and discrete from said element, for supporting said element in a position to receive the grooved portion of the spindle means when the spindle means is in rotatable relation with the bearing means and the latter is supported by said first mounting means.

2. A rotary connector assembly as recited in claim 1 wherein:

each electrical conducting element comprises a first portion extending through said spindle means, from said grooved portion toward said first end portion thereof, and a connecting portion extending between said ring portion and said first portion of the conducting element;

said rotary connector assemby comprises cable means having a plurality of strands;

said spindle means comprises means for receiving said strands internally within said spindle means;

and said rotary connector assembly comprises means for electrically connecting each strand with the first portion of a respective conducting element, internally within said spindle means.

3. A rotary connector assembly as recited in claim 1 wherein:

said electrical contacts comprise means for removably engaging the contacts to an electrical connector plug.

4. A rotary connector assembly as recited in claim 1 wherein said spindle means comprises:

a plurality of first internal grooves each extending in a direction transverse to said axis of rotation and having an outer end communicating with a respective peripheral groove;

a plurality of second internal grooves each extending in a direction substantially parallel to said axis and communicating with at least one of said first internal grooves;

a plurality of peripheral channels each extending on the periphery of said spindle means between said grooved portion and said first end portion of the spindle means;

a plurality of pocket means each extending toward the interior of said spindle means from a respective peripheral channel and each having an inner end portion;

and means within said spindle means for communicating each of said second internal grooves with a member of the group comprising (1) a respective one of said peripheral channels and (2) a respective one of said pocket means.

5. A rotary connector assembly as recited in claim 1 wherein:

said grooved portion of the spindle means is cylindrical; and all of said ring portions have the same diameter.

6. A rotary connector assembly as recited in claim 1 wherein:

said U-shaped element comprises means mounting said plurality of electrical contacts in spaced-apart, non-contacting relation;

and each of said contacts has a pair of spaced-apart wiper portions each comprising means for engaging the corresponding ring portion on a respective opposite side of the spindle's grooved portion.

7. A rotary connector assembly as recited in claim 6 wherein:

each contact comprises a connecting portion joining said spaced-apart wiper portion;

said U-shaped element has a pair of spaced-apart slots for each of said contacts;

each wiper portion on a contact extends through a respective one of said pair of slots;

said U-shaped element includes a plurality of spacers thereon;

and each spacer comprises means for engaging a connecting portion on a respective contact when that contact's wiper portions extend through their respective slots on the U-shaped element.

8. A rotary connector assembly for the handset of a telephone, said assembly comprising:

spindle means comprising axially spaced first and second end portions, and a grooved portion comprising a plurality of axially spaced peripheral grooves each axially spaced from said first end portion;

said spindle means having an axis of rotation;

a plurality of electrical conducting elements each having a ring portion received in a respective one of said peripheral grooves of the spindle means;

a plurality of electrical contacts;

an element comprising means for receiving said grooved portion of the spindle means;

said element also comprising means mounting each of said electrical contacts in a position to engage a respective ring portion when the grooved portion of the spindle means is received by the element;

each electrical contact comprising means for engaging a respective ring portion;

bearing means for the spindle means;

said bearing means and said spindle means comprising means cooperating to mount said bearing means and said spindle means in mutually rotatable relation;

first mounting means for supporting said bearing means;

second mounting means for supporting said element in a position to receive the grooved portion of the spindle means when the spindle means is in rotatable relation with the bearing means and the latter is supported by said first mounting means;

each electrical conducting element comprising a first portion extending through said spindle means, from said grooved portion toward said first end portion thereof, and a connecting portion extending between said ring portion and said first portion of the conducting element;

cable means having a plurality of strands;

said spindle means comprising means for receiving said strands internally within said spindle means;

and means for electrically connecting each strand with the first portion of a respective conducting element, internally within said spindle means;

said electrical connecting means comprising a plurality of contact jumpers;

said spindle means having a periphery and comprising pocket means extending inwardly from said periphery, between said groove portion and said first end portion of the spindle means;

said pocket means communicating with said means for receiving said strands and comprising means for seating each contact jumper in a position to engage both a strand and the first portion of a respective conducting element.

9. A rotary connector assembly as recited in claim 8 wherein:

said bearing means is cylindrical and encloses at least part of each contact jumper.

10. A rotary connector assembly as recited in claim 8 wherein:

said spindle means comprises a plurality of channels extending from the grooved portion toward said first end portion of the spindle means on the periphery thereof;

each of said channels communicates with said inwardly extending pocket means;

and each of said channels comprises means for receiving a part of the first portion of a respective conducting element.

11. A rotary connector assembly for the handset of a telephone, said assembly comprising:

spindle means comprising axially spaced first and second end portions, and a grooved comprising a plurality of axially spaced peripheral grooves each axially spaced from said first end portion;

said spindle means having an axis of rotation;

a plurality of electrical conducting elements each having a ring portion received in a respective one of said peripheral grooves of the spindle means;

a plurality of electrical contacts;

an element comprising means for receiving said grooved portions of the spindle means;

said element also comprising means mounting each of said electrical contacts in a position to engage a respective ring portion when the grooved portion of the spindle means is received by the element;

each electrical contact comprising means for engaging a respective ring portion;

bearing means for the spindle means;

said bearing means and said spindle means comprising means cooperating to mount said bearing means and said spindle means in mutually rotatable relation;

first mounting means for supporting said bearing means;

second mounting means for supporting said element in a position to receive the grooved portion of the spindle means when the spindle means is in rotatable relation with the bearing means and the latter is supported by said first mounting means;

a base member separate and discrete from said element and from said bearing means;

each of said first and second mounting means being located on said base member;

a second member located in superimposed relation to said base member;

means for attaching said second member to said base member;

and means on said second member for engaging said bearing means and for retaining the latter in a supported position on said first mounting means, when the second member is attached to the base member.

12. A rotary connector assembly as recited in claim 11 wherein:

said bearing means is cylindrical and encloses said first portion of the spindle means as well as a part of the spindle means between its first end portion and its grooved portion;

means on said grooved portion of the spindle means for retaining said element in a supported position on said second mounting means, when the cylindrical bearing means (a) encloses said portion and said part of the spindle means and (b) is retained in its supported position on the first mounting means.

13. A rotary connector assembly as recited in claim 11 wherein:

said base member comprises means for preventing movement of said spindle means and said bearing means in an axial direction.

14. A rotary connector assembly as recited in claim 11 wherein said base member comprises:

means for preventing movement of said element in an axial direction, relative to the spindle means;

and means for preventing movement of the element along said base in a direction transverse to said axial direction.

15. A rotary connector assembly for the handset of a telephone said assembly comprising:

spindle means comprising axially spaced first and second end portions;

said spindle means having an outer periphery and an axis of rotation;

electrical conducting means around the periphery of said spindle means;

electrical contact means;

an element comprising means for receiving said spindle means and said electrical conducting means;

said element also comprising means mounting said electrical contact means in a position to engage said electrical conducting means on the spindle's periphery;

bearing means for the spindle means;

said bearing means and said spindle means comprising means cooperating to mount said bearing means and said spindle means in mutually rotatable relation;

a base member, separate and discrete from said element and said bearing means, and comprising means for supporting said element and said bearing means;

a second member aligned with said base member;

means for attaching said second member to said base member;

and means on said second member for engaging said bearing means and for retaining the latter in a supported position on said base member, when the second member is attached to the base member;

said assembly comprising means cooperating to enable the entire assembly to be attached to, or removed from, the handset of a telephone as a single, integral unit.

16. A rotary connector assembly as recited in claim 15 wherein:

said bearing means is cylindrical and encloses at least an end portion of the spindle means;

said assembly comprising means on said spindle means for retaining said element in a supported position on said base member, when the cylindrical bearing means encloses said end portion of the spindle means and (b) is retained in its supported position on the base member.

17. A rotary connector assembly as recited in claim 15 wherein:

said base member comprises means for preventing movement of said spindle means and said bearing means in an axial direction.

18. A rotary connector assembly as recited in claim 15 wherein said base member comprises:

means for preventing movement of said element in an axial direction, relative to the spindle means;

and means for preventing movement of the element along said base member in a direction transverse to said axial direction.

19. A rotary connector assembly as recited in claim 15 wherein:

said electrical contact means comprises means for removably engaging the electrical contact means to an electrical connector plug.

20. In combination with the rotary connector assembly of claim 19:

a telephone handset;

and a electrical connector plug within said handset, for engagement with said engaging means on the rotary connector assembly.

21. In a telephone:

a handset having a speaker end and an opening adjacent said speaker end;

a first female modular connector element within said handset, adjacent said speaker end, and spaced from and aligned with said opening;

a rotary connector assembly;

said opening comprising means for receiving at least a part of said rotary connector assembly within said handset;

said rotary connector assembly comprising a housing and a spindle received within said housing;

said housing and said spindle comprising means mounting the housing and the spindle in mutually rotatable relation about a common axis;

a male modular connecting element for engaging within said first female modular connecting element;

means mounting said male modular connecting element on said rotary connector assembly, for rotation with said spindle;

a second female modular connecting element aligned with said opening;

means mounting said second female modular connecting element on said rotary connector assembly for rotation with said housing;

bearing means on said housing for seating at said handset opening to mount the housing for rotation relative to said handset;

said second female modular connecting element comprising means for receiving a male modular connecting element;

electrical conducting means on the exterior of the spindle;

wiper means electrically connecting said second female modular connecting element to said electrical conducting means on the spindle exterior;

and means electrically connecting said electrical conducting means on the spindle exterior to said firstrecited male modular connecting element.

22. In a telephone as recited in claim 18 and comprising:

a speaker contact housing within said handset at said speaker end;

said speaker contact housing comprising a rear wall having a first portion relatively close to said opening in the handset and a second portion relatively remote from said opening;

said first female modular connecting element being located on said rear wall of the speaker contact housing at said second portion thereof and extending inwardly therefrom relative to the speaker end.

23. In a telephone as recited in claim 22 wherein:

said first recited male modular connecting element comprises latch means depressible for disengaging said male modular connecting element from the first female modular connecting element, to enable the withdrawal of said rotary connector assembly from within said handset;

and an opening in the rear wall of the speaker contact housing, alongside said first female modular connecting element;

said opening comprising means through which a pin may be inserted, from said speaker end, to engage and depress said latch means on the first recited male modular connecting element;

said opening comprising means for guiding said pin into engagement with said latch means.

24. In a telephone as recited in claim 23 wherein:

said latch means is located within said handset and is inaccessible through said first-recited opening in the handset when the first-recited male modular connecting element engages the first female modular connecting element;

and said telephone comprises manually removable mouthpiece means at said speaker end, said mouthpiece means normally preventing access to said opening in the rear wall of the speaker contact housing, but allowing access to said rear wall opening when said mouthpiece means has been removed.

25. In a telephone set as recited in claim 21 wherein:

substantially all of said rotary connector assembly, including said male modular connecting element and said second female modular connecting element, are located within the interior of said handset.

26. A spindle for use in a rotary connector assembly, said spindle having an axis of rotation and comprising:

axially spaced first and second end portions;

a grooved portion comprising a plurality of axially spaced peripheral grooves each axially spaced from said first end portion;

a plurality of first internal grooves each extending in a direction transverse to said axis and having an outer end communicating with a respective peripheral groove;

a plurality of second internal grooves each extending in a direction substantially parallel to said axis and communicating with at least one of said first internal grooves;

a plurality of peripheral channels each extending on the periphery of said spindle between the spindle's grooved portion and the spindle's first end portion;

a plurality of pocket means each extending toward the interior of said spindle from a respective peripheral channel and each having an inner end portion;

and means within said spindle for communicating each of said second internal grooves with a member of the group comprising (1) a respective one of said peripheral channels and (2) a respective one of said pocket means.

27. A spindle as recited in claim 26 wherein said last-recited means communicates with said peripheral channels and comprises:

a plurality of transverse grooves each extending between a respective second internal groove and a respective peripheral channel.

28. A spindle as recited in claim 26 wherein said communicating means communicates with said pocket means and comprises:

a plurality of internal channels extending between a respective second internal groove and a respective inner end portion of a pocket means.

29. A spindle as recited in claim 26 and comprising:

a recess at said first end portion of the spindle;

said recess communicating with said inner end portion of each pocket means.

30. In combination with the spindle of claim 26, a plurality of conducting elements carried by said spindle, each conducting element comprising:

a ring portion received within a respective peripheral groove on the spindle;

a transverse portion, integral with said ring portion, and received within a respective first internal groove in the spindle;

a connecting portion integral with said transverse portion and having a first sub-part received within a respective second internal groove in the spindle;

and an end portion at least part of which is received within a respective pocket means at the inner end portion thereof;

said connecting portion having a second sub-part, integral with said first sub-part, extending at an angle from the first sub-part and joining the first sub-part to said end portion.

31. In the combination of claim 30 wherein:

said communicating means communicates with said peripheral channels and comprises a plurality of transverse grooves each extending between a respective second internal groove and a respective peripheral channel;

and said second sub-part on the connecting portion of the conducting element is received in a respective one of said last-recited transverse grooves.

32. In the combination of claim 30 wherein:

said communicating means communicates with said pocket means and comprises a plurality of internal channels each extending between a respective second internal groove and a respective inner end portion of a pocket means;

and said second sub-part on the connecting portion of the conducting element is received in a respective one of said internal channels.

33. A rotary connector assembly for the handset of a telephone, said assembly comprising:

a base member;

spindle means having an axis of rotation;

said spindle means comprising axially spaced first and second end portions, and a peripheral portion said end portions;

a plurality of axially spaced electrical conducting rings disposed around said peripheral portion of the spindle means;

a plurality of electrical contacts;

an element separate and discrete from said base member;

said element comprising means for receiving and partially surrounding said peripheral portion of the spindle means;

means mounting said element at a predetermined position on said base member;

said element also comprising means mounting said electrical contacts in spaced apart, non-contacting relation, with each contact in a position to engage a respective ring when the peripheral portion of the spindle means is received by said element;

means mounting the spindle means for rotation, about its axis, relative to said base member;

means for holding the spindle means in a predetermined position, on said base member, and in which the peripheral portion of said spindle means is received by said element;

and means on said peripheral portion for retaining said element in its position on the base member, when the spindle means is held in its predetermined position.

34. A rotary connector assembly as recited in claim 33 and comprising:

means cooperating to enable the entire assembly to be attached to, or removed from, the handset of a telephone as a single, integral unit.

35. A sub-assembly for use in a rotary connector assembly having a rotatable spindle including a peripheral portion, said sub-assembly comprising:

a U-shaped element comprising means for receiving the peripheral portion of said rotatable spindle;

a plurality of electrical contacts;

said U-shaped element comprising means mounting said plurality of electrical contacts in spaced-apart, non-contacting relation, with each contact positioned to engage a respective one of a plurality of axially spaced locations on the peripheral portion of the rotatable spindle when the latter is received by said U-shaped element;

each of said contacts having a pair of spaced-apart wiper potions each comprising means for engaging a respective opposite side of the spindle's peripheral portion at the location on the latter engaged by that contact;

each contact comprising a connecting portion joining said spaced-apart wiper portions;

said U-shaped element has a pair of spaced-apart slots for each of said contacts;

each wiper portion on a contact extends through a respective one of said pair of slots;

said U-shaped element includes a plurality of spacers thereon;

and each spacer comprises means for engaging a connecting portion on a respective contact when that contact's wiper portions extend through their respective slots on the U-shaped element.

* * * * *